US005406647A

United States Patent [19]

Lew

[11] Patent Number: 5,406,647

[45] Date of Patent: Apr. 18, 1995

[54] CLOTHING INTEGRATED AERODYNAMIC MODULES FOR CYCLING, SKATING AND OTHER SPEED SPORTS

[75] Inventor: Paul E. Lew, Carmel, Ind.

[73] Assignee: Wear and Tear, Inc., Indianapolis, Ind.

[21] Appl. No.: 124,406

[22] Filed: Sep. 20, 1993

Related U.S. Application Data

[63] Continuation-in-part of Ser. No. 21,151, Mar. 8, 1993, Pat. No. 5,371,903, which is a continuation-in-part of Ser. No. 851,812, Mar. 16, 1992, abandoned.

[51] Int. Cl.[6] ..... A41D 1/08

[52] U.S. Cl. ..... 2/69; 2/88; 2/1

[58] Field of Search ..... 2/88, 2, 16, 108, 177, 2/175, 196, 267, 59, 410, 425, 69, 1; 280/841, 11.19, 11.3, 809, 810, 811, 24, 32.7

[56] References Cited

U.S. PATENT DOCUMENTS

| | | | |
|---|---|---|---|
| 1,677,187 | 7/1928 | Leibson . | |
| 3,936,075 | 2/1976 | Jelliffe . | |
| 4,193,134 | 3/1980 | Hanrahan et al. . | |
| 4,599,747 | 7/1986 | Robinson . | |
| 4,901,898 | 2/1990 | Colombo et al. . | |
| 5,048,123 | 9/1991 | Monson | 2/108 |
| 5,077,838 | 1/1992 | Senser | 2/108 |
| 5,079,778 | 1/1992 | Sloot | 2/244 |
| 5,106,331 | 4/1992 | Lizarazu | 2/2 |
| 5,251,337 | 10/1993 | Sloot | 2/115 |

FOREIGN PATENT DOCUMENTS

| | | |
|---|---|---|
| 370553 | 3/1923 | Germany . |
| 671864 | 10/1989 | Switzerland . |

*Primary Examiner*—Clifford D. Crowder
*Assistant Examiner*—Gloria Hale
*Attorney, Agent, or Firm*—Baker & Daniels

[57] ABSTRACT

A wind drag reducing suit with integrated aerodynamic modules for use by speed sport athletes such as skaters and cyclists. The wind drag reducing suit is made from flexible fabric, and the aerodynamic modules of the suit are made integral therewith and fabricated as a flexible fabric composite. One form of the aerodynamic modules is as a rearwardly extending aerodynamic wedge-shaped module disposed on the portion of the suit sleeves which cover either the rear of the athlete's upper arm or lower leg. Another form of the aerodynamic modules is as a rear spoiler board, which is integral with the portion of the suit which covers the athlete's torso back, and which therefore is disposed on the back of the athlete when the suit is worn. Another form of the aerodynamic modules is as a vortex generator which projects from the exterior surface of the suit. The vortex generators, which each have a vertical cross section or profile shaped similar to the top half of an airfoil and a lateral cross section which is boomerang-like in shape, can be positioned on the suit at locations which cover the head or torso of the athlete. The wind drag reducing suit of the present invention can be fashioned with a single form of the aerodynamic modules or alternatively with several forms of modules integrated into the suit.

22 Claims, 7 Drawing Sheets

CLOTHING INTEGRATED AERODYNAMIC MODULES FOR CYCLING, SKATING AND OTHER SPEED SPORTS

CROSS REFERENCE TO RELATED APPLICATIONS

This patent application is a continuation-in-part of my prior patent application, Ser. No. 08/021,151, filed Mar. 8, 1993, U.S. Pat. No. 5,371,903, which in turn is a continuation-in-part of my prior patent application, Ser. No. 07/851,812, filed Mar. 16, 1992, now abandoned.

BACKGROUND OF THE INVENTION

This invention relates to wind drag reducing suits for speed sport athletes, and, in particular, to aerodynamic modules integrated into wind drag reducing suits worn by such athletes, for example cyclists, skaters, or skiers, to improve laminar air flow and reduce wind drag and thereby increase the athletes' speed for the same energy output.

In an attempt to achieve greater speeds in a wide variety of sports, attention has been focused on overcoming, or in other words limiting, the adverse effects of wind resistance. On the racing front, less wind resistance for a given driving force translates to faster speeds. As a result, Indy type cars and drivers have incorporated aerodynamic advances into car and helmet design. For instance, one type of aerodynamic device utilized is a splayed-open-V-shaped vortex generator, which has been incorporated into Indy car frames and driver helmets to enhance their respective aerodynamics. These vortex generators, which are employed on a surface over which air passes, project outward from that surface and are oriented with the point of the V-shaped generator directed into the passing air. However, to date, the use of this aerodynamic device or technology has been limited.

Nonetheless, the benefits of improved aerodynamics have repeatedly been recognized in other forms by speed sport athletes such as cyclists. Over the years, a number of advancements have been made both in the design of bicycles for cycling competitions as well as some limited advancements in clothing for cyclists. With respect to bicycle design, aerodynamic concerns have led to bicycle wheels being improved to reduce wind drag on the spokes. The multi-spoke wheel has given way to the solid or composite wheel. The handlebars have also been improved and shaped and contoured in such a way as to provide both a more aerodynamic design and a forearm support surface. The current design of these contoured handlebars enables the cyclist to lean forward and bring the hands together into both a comfortable cycling position and a more aerodynamically compact position, whereby the smaller the projected frontal area the cyclist pushes through the wind, the more aerodynamic the cyclist and bicycle.

Clothing advancements have also improved the aerodynamics of cycling. Cyclist currently wear tight fitting clothing to try and reduce as much as possible any loose fabric which would "catch" the wind and increase the drag coefficient of the cyclist. While a focus on reducing the drag coefficient is not of any particular concern for purely casual or social bicycling, it can be critical in competitive cycling situations. While the above improvements are a step toward enhancing aerodynamics, additional improvements continue to be sought to optimize performance.

The two parent applications, cited above, of the present application disclose and expressly describe aerodynamic modules which have addressed the aerodynamic concerns of athletes by further improving the aerodynamics of a speed sport athlete such as a cyclist. The disclosure and teachings of those applications are explicitly incorporated herein by reference.

SUMMARY OF THE INVENTION

In one form thereof, the wind drag reducing suit of the present invention for a speed sport athlete includes a torso covering means for covering at least a part of the torso of the athlete, a sleeve means defining a passageway for receiving a limb of the athlete therein when the suit is worn by the athlete, and an aerodynamic module integral with the sleeve means. The sleeve means extend from the torso covering means, and the module is substantially wedge-shaped in cross section transverse to the sleeve means passageway. Preferably, the aerodynamic module extends rearwardly from the sleeve means and includes a top surface, a trailing edge, and opposing side surfaces.

In another form thereof, the wind drag reducing suit of the present invention includes a sleeve means defining a passageway for receiving a limb of the athlete therein, and an aerodynamic module connected to the sleeve means. The sleeve means is made from a flexible fabric, and the module is made from a flexible fabric composite.

In yet another form thereof, the wind drag reducing suit of the present invention includes a torso covering means for covering at least a part of the torso of the athlete, and a rear spoiler board integral with the torso covering means. The spoiler board is made from a flexible fabric composite and is disposed on the back of the speed sport athlete when the suit is worn.

In still another form thereof, the wind drag reducing suit of the present invention has at least one vortex generator projecting from the exterior surface of the suit. The vortex generator is positioned on the suit in a manner to improve the aerodynamics of an athlete utilizing the suit. Appropriate locations for positioning a vortex generator include on the suit portion which covers the torso back or on a suit hood portion. The suit is generally made of a flexible fabric, and the vortex generator can be made from a flexible fabric composite.

An advantage of the present invention is that it provides an aerodynamic module which is integrated into the clothing of a speed sport athlete, thereby improving the aerodynamics and consequently the performance of the speed sport athlete. Other advantages of the present invention will become apparent from the following description.

BRIEF DESCRIPTION OF THE DRAWINGS

Corresponding reference characters indicate corresponding parts throughout the several Figures.

DESCRIPTION OF THE PREFERRED EMBODIMENTS

Figure 1:
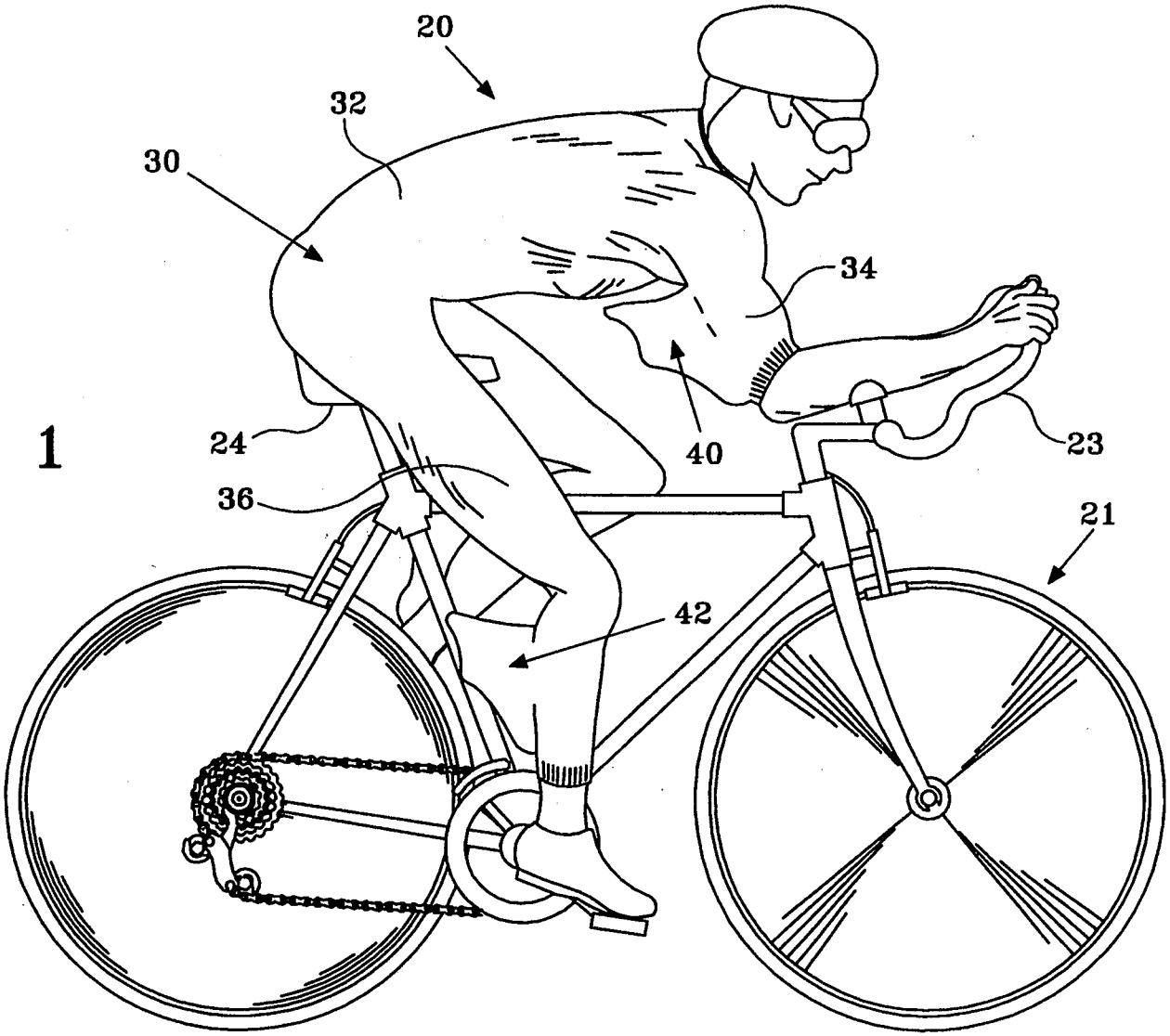
FIG. 1 is a side elevational view of a cyclist wearing a wind drag reducing suit with aerodynamic wedge-shaped modules of the present invention.

Referring to FIGS. 1–5, there is shown one embodiment of the clothing integrated aerodynamic modules of the present invention. FIG. 1 illustrates cyclist or speed sport athlete 20 riding a competition bicycle, generally designated 21, having seat 24. The details of bicycle 21 are not particularly important for an understanding of the present invention. The most relevant, though not essential, feature of bicycle 21 is the contoured and forward protruding style of handlebars 23. The shape of handlebars 23 enables cyclist 20 to cycle in a comfortable position whereby cyclist 20 leans forward with his head lowered, his back fairly flat, and with his upper body supported by placement of his forearms on handlebars 23. As a result, the upper arms are disposed substantially perpendicular to the forearms and consequently the direction bicycle 21 travels. The forearms of cyclist 20 cause limited wind resistance as they are pointed nearly directly into the oncoming wind. The aerodynamic modules of the present invention do not cause or require any change to the manner of cycling, but rather relate to the apparel worn by cyclist 20.

As shown in FIG. 1, cyclist 20 naturally has a torso with a pair of legs and arms extending therefrom. Cyclist 20 is wearing or otherwise outfitted in a wind drag reducing suit, generally designated 30, with aerodynamic modules of the present invention. As is known in the art, suit 30 is a form-fitting, body hugging piece of apparel or clothing. Suit 30 is fabricated from a stretchable, flexible fabric such as a LYCRA® spandex Du Pont fiber. Other fabrics or materials, such as nylon, which have similar wind drag reducing qualities due to their tight fit on cyclist 20 can be substituted for spandex. Suit 30 is illustrated as a one piece bodysuit having a torso covering region 32 which entirely covers the front and back of the torso of cyclist 20 from the groin region to the neck. To utilize the clothing integrated aerodynamic modules of the present invention, such a complete covering of the torso is not necessary, but is nonetheless recommended to best reduce air resistance.

A pair of arm sleeves 34 (the left arm sleeve is not shown but is a mirror image of the shown right arm sleeve) extend from and are connected to torso covering region 32. In the illustrated embodiment, each arm sleeve 34 extends to approximately the elbow of cyclist 20, and could extend up to the wrist area if desired without affecting the function of the invention. Arm sleeve 34 includes a passageway 35 (see FIG. 3) which receives the upper arm of cyclist 20 when suit 30 is put on and worn by cyclist 20. Arm sleeve 34 stretches to snugly conform around the upper arm of cyclist 20. A pair of leg sleeves 36 or pant legs (the left leg sleeve is not shown but is a mirror image of the shown right leg sleeve) also extend from and are connected to torso covering region 32. Each leg sleeve 36 extends down the leg to proximate the lower calf, and preferably to the ankle region, of cyclist 20. Each leg sleeve 36 by definition includes a passageway, and the passageway receives the upper leg and lower leg calf portion of cyclist 20 when suit 30 is employed or worn by cyclist 20. Each leg sleeve 36 stretches to tightly conform around the cyclist's leg. Of course, if a one-piece full body suit is not desired, cyclist 20 could instead opt to wear a multiple piece suit, such as a shirt suit with arm sleeves combined with a pant suit with leg sleeves, while still employing the aerodynamic modules of the present invention. Alternatively, cyclist 20 could choose to wear only a shirt suit with modules 40 or a pant suit with modules 42. Moreover, if a full body suit was worn, the body suit may include only modules 40 without modules 42, or alternatively only modules 42 without modules 40.

Referring to FIG. 1, disposed on the rearward side of arm sleeve 34 is an aerodynamic wedge-shaped module, generally designated 40. Similarly disposed on the rearward side of the cyclist calf covering portion of each leg sleeve 36 is an aerodynamic wedge-shaped module, generally designated 42. Although the actual dimensions of modules 40, 42 may be varied in order to provide the best aerodynamic design, the preferred designs have module 40 extending from proximate the cyclist armpit area to proximate the elbow and module 42 extending from just below the knee area to proximate the ankle. Because the concept, although not necessarily the actual dimensions, of module 40 is identical to module 42, explanation herein will address module 40 but will have similar application to module 42. In addition, although only the right arm sleeve module 40 and right leg sleeve module 42 are completely illustrated, the arm sleeve and leg sleeve of suit 30 which respectively receive the left upper arm and left lower leg each include aerodynamic wedge-shaped modules which are mirror images of their corresponding modules 40, 42.

Referring to FIGS. 2–5, there is shown enlarged views of aerodynamic wedge-shaped module 40. As more fully described below, the fabrication of module 40 utilizes a flexible fabric similar, and preferably identical, to that fabric used for suit 30. During manufacture, the flexible fabric of the module is stiffened by the application of a liquid coating which hardens or otherwise solidifies. This coupling of the flexible fabric with the coating results in module 40 being a flexible fabric composite. Furthermore, module 40 will maintain its shape under normal operating conditions. Thus, the aerodynamic module 40 illustrated is actually a stiffened rearward extension of arm sleeve 34 having a contoured shape that acts as a type of airfoil to reduce wind drag by diverting and directing the flowing air so as to reduce or eliminate the creation of any vortex like air currents that would increase the drag on the cyclist. The more aerodynamic shaping of the contour of cyclist 20 which results from employing module 40 gives the cyclist an increase in speed for the same energy expenditure.

Figure 2:
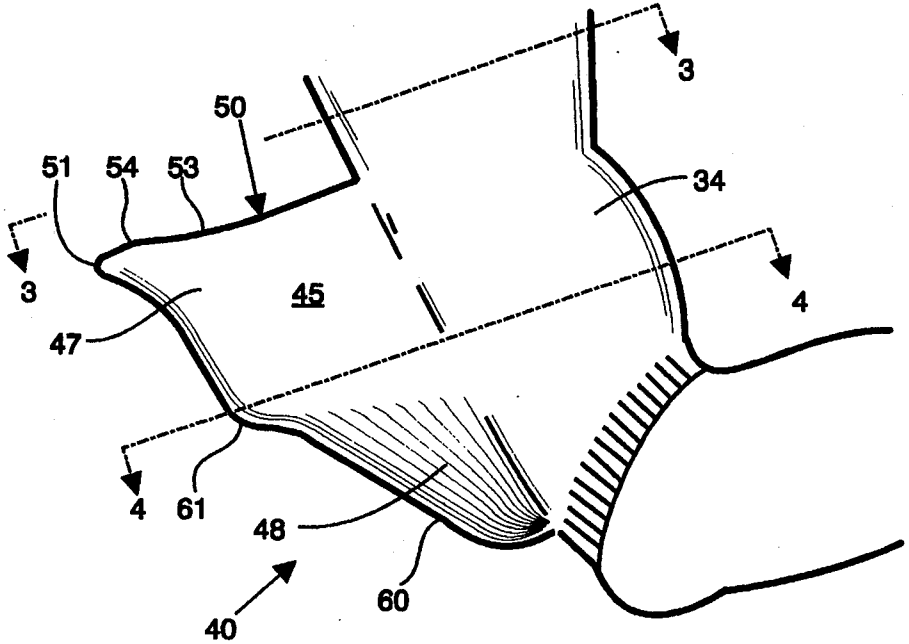
FIG. 2 is an enlarged side elevational view from FIG. 1 of the suit with the upper arm disposed aerodynamic wedge-shaped module.

With respect to its overall configuration, module 40 extends rearwardly from arm sleeve 34 and includes opposing generally vertically disposed side surfaces 45, 46 shaped and sized to produce a substantially triangular module profile. Each side essentially comprises an upper region 47 and a lower region 48, the imaginary horizontal line separating the two regions extending through the sharply angled portion 61 of trailing edge 60. The left area (in FIG. 2) of lower region 48, as bounded by trailing edge 60, is so configured to allow the knee of the pedaling cyclist to pass in close proximity to aerodynamic wedge-shaped module 40 without striking module 40. A module top surface 50 defines the top edges of side surfaces 45, 46 and extends therebetween. As shown in FIG. 2, top surface 50 is vertically undulating, having both a concave portion 53, which is proximate the middle of the rearward extension of surface 50, and a convex portion 54, which begins proximate the rearward end of portion 53 and continues to end 51. Top surface 50 also tapers in horizontal thickness rearwardly (see FIG. 3), resulting in surface 50 exhibiting a substantially wedge-shaped form. Near end 51, top surface 50 is curved slightly inwardly toward the torso of cyclist 20.

Figure 3:
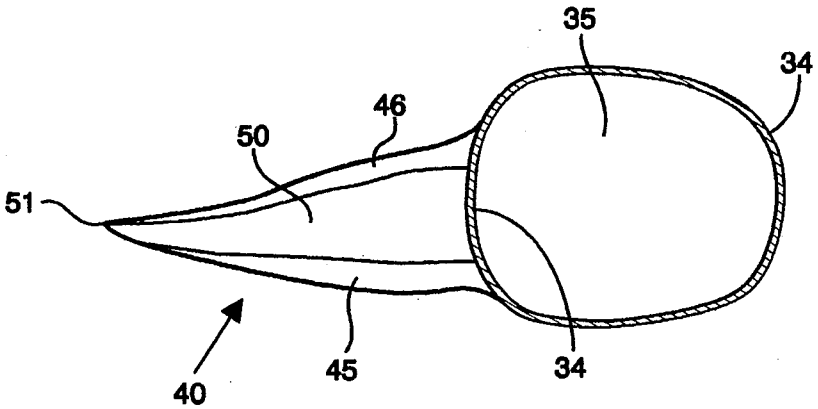
FIG. 3 is a top view of the aerodynamic wedge-shaped module of the suit taken along line 3—3 of FIG. 2, wherein the cyclist's arm has been removed from the suit.
Figure 4:
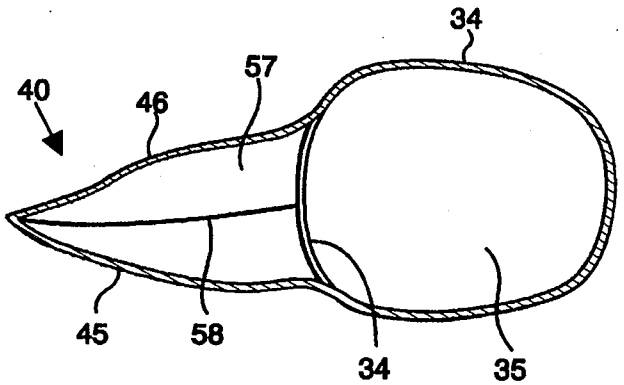
FIG. 4 is a cross sectional view of the aerodynamic wedge-shaped module of the suit taken along line 4—4 of FIG. 2, wherein the cyclist's arm has been removed from the suit.
Figure 5:
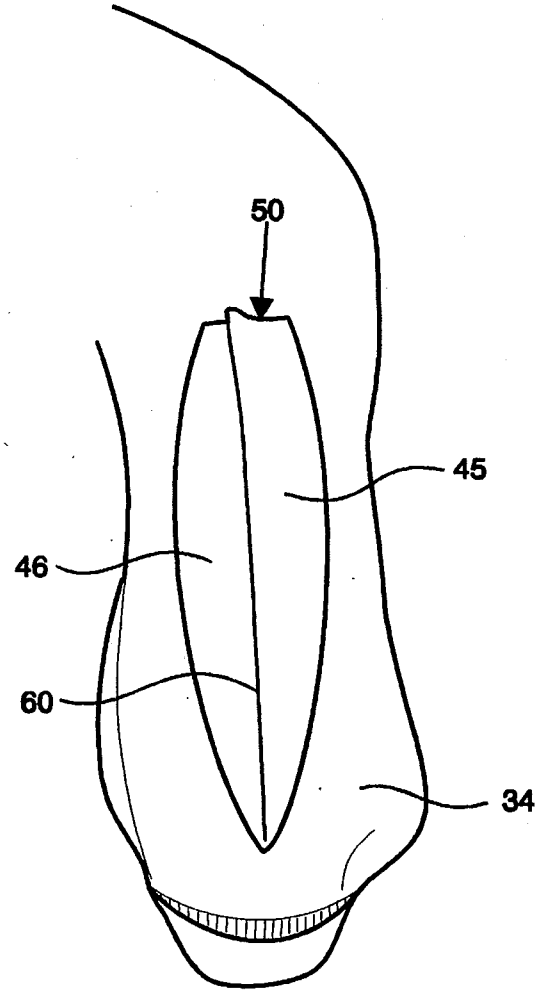
FIG. 5 is a rear elevational view of the aerodynamic wedge-shaped module of the suit.

As best shown in FIGS. 3–5, as opposing side surfaces 45, 46 extend rearwardly they converge. As a result, module 40 has a cross section, as taken transverse to the axis of passageway 35 in arm sleeve 34, which is similar to the shape of top surface 50 in that the cross section is substantially wedge-shaped as well. The interior 57 of module 40 is hollow, and is defined by the fabric inner surfaces of side surfaces 45, 46, the fabric inner surface of top surface 50, and passageway 35. The convergence of triangular profile side surfaces 45, 46 along the height of module 40 also results in a module trailing edge 60 which at different heights if located at different distances from arm sleeve 34. Due to the way module 40 is formed as described below, trailing edge 60 is formed at the connecting seam 58 between side surfaces 45, 46. Trailing edge 60 preferably extends continuously from distal end 51 of top surface 50 all the way to arm sleeve 34 at a point proximate the sleeve end near the elbow of cyclist 20.

A further understanding of the design of this embodiment of the present invention will result from an explanation of its fabrication. Module 40 is preferably of a unitary construction with arm sleeve 34, i.e. fabricated out of the same continuous piece of flexible fabric which is used to form arm sleeve 34. Module 40 could also be made separately, while still utilizing the flexible fabric composite design explained herein, and subsequently be attached, for instance by sewing, to arm sleeve 34. In either case, module 40 would be integral with arm sleeve 34, or in other words could not be detached from arm sleeve 34. In the preferred construction, arm sleeve 34 can be constructed by rolling up and connecting together two opposing sides of a generally rectangular segment of flexible fabric material to form a cylindrical sleeve, i.e the arm receiving portion of arm sleeve 34. However, not only is the segment not completely rectangular in the sense that the cylinder of fabric is not uniform in cross section but tapers in diameter downwardly to conform to a typical arm physique, the segment also includes a pair of flexible fabric extensions, one on each of the connected sides of the rectangular segment. The flexible fabric extensions have the same basic shape as the profile of module 40 shown in FIG. 2, and when arm sleeve 34 is rolled up and connected with torso covering region 32, the extensions extend rearwardly from the arm sleeve. As shown in FIG. 4, the fabric extensions of the sleeve are separated by a finite space at the rear portion of arm sleeve 34, and therefore arm sleeve 34 does not completely enwrap the upper arm of cyclist 20 where module 40 is located. Thus, when the fabric extensions are connected to form module 40 as described more fully below, the internal volume of the connected fabric extensions which becomes the hollow interior 57 of module 40 opens into arm passageway 35.

During the stitching together of the rectangle sides to form arm sleeve 34, the perimeters of the flexible fabric extension are also sewn together at seam 58, thereby creating a rearwardly extending flexible fabric pocket. Although the outline of the pocket is similar to the shape of side surfaces 45, 46 of finished module 40, the fact that at this stage of fabrication the pocket comprises nothing more than flexible fabric causes the pocket to be easily deformable and movable, resulting in a somewhat amorphously shaped enclosed volume.

The next series of fabrication steps results in the transformation of the flexible fabric pocket into the module 40 having a flexible fabric composite construction. A mold, having a preselected aerodynamically contoured shape, is inserted through passageway 35 of arm sleeve 34 and into the flexible fabric pocket. The pocket has purposely been formed with a volume slightly smaller than the volume of the mold, which is made of a sufficiently solid material such as wood so that is will not deform. Due to the stretch characteristics of the preferred spandex fabric, the flexible fabric pocket stretches to receive the mold, which is forced entirely into the pocket. Consequently, the flexible fabric pocket assumes the external shape of the mold. While maintaining the mold in place, a coating is then applied as described below, resulting in a flexible fabric composite. As used herein, a composite refers to the product resulting from the application, to a binder, of a liquid which cures to a solid. Thus, the flexible fabric of the pocket is the binder for module 40, and the applied coating is the liquid which cures to the solid. The coating serves to stiffen the fabric pocket such that the resulting module 40 retains the shape of the mold even after mold removal.

It is known in the art of composite coatings that numerous coatings, such as an assortment of long chain polymers, can be employed to stiffen items such as fabrics. Coatings comprising a wide variety of one or more long chain polymers may be used to stiffen the flexible fabric of module 40. Although two preferred coating compositions are identified hereinbelow, one skilled in the art will recognize that other suitable long chain polymeric compositions may be substituted without departing from the teachings of the present invention. The stiffening of the flexible fabric of module 40 refers to the finished module's resistance to being deformed by the external forces encountered during use. Two urethane compositions available from Ad-Tech of Charlotte, Mich. are preferred to stiffen the flexible fabric composite. These compositions, identified by the manufacturer as EL301 and EC405, respectively, are supplied by the manufacturer as an unmixed, two-part mixture comprising a resin (designated "Part A" by the manufacturer) and a hardener (designated "Part B" by the manufacturer). The manufacturer's suggested mixture combination of EL301 is 100 parts by weight Part A with 25 parts by weight Part B. The resulting urethane has a hardness of 88D. The manufacturer does not provide a single suggested mixture combination for EC405 but rather provides variable combinations or mix ratios which may be used to obtain urethanes having hardnesses ranging from 35D to 65D. It is presently preferred that a composite coating with a high hardness rating be utilized due to its greater composite stiffness. The mix ratio suggested by the manufacturer which provides the 65D hardness consists of a mixture or combination of 55 parts by weight Part A with 45 parts by weight Part B.

For a given composite coating thickness, flexible fabric composites fabricated with urethanes having a high hardness will be more stiff than flexible fabric composites fabricated with urethanes having a low hardness. However, a composite fabricated with a low hardness urethane might be made as stiff as a composite fabricated with a high hardness urethane if additional layers of the same low hardness urethane were applied to the composite fabricated with the low hardness urethane. While adding stiffness, additional coating layers add weight to the suit, which may diminish the benefits sought by use of the module. Wind tunnel tests and scientific experimentation may be performed utilizing various coating compositions and various thicknesses of these compositions on the flexible fabric composites to determine optimum stiffness and weight characteristics for a particular use.

EL301 is the preferred urethane due to its high hardness. This urethane is prepared by mixing the two part mixture according to the manufacturer's suggested combination specified above, and is then applied onto the exterior of the flexible fabric covering the inserted mold. For example, at a room air temperature about 77° F. (25° C.), the application of the EL301 urethane should occur within twenty minutes after mixing, as further delay makes application more difficult as the urethane begins to slightly harden. At a room air temperature above about 77° F. (25° C.), the urethane should generally be applied within a shorter time period, as it begins to harden more quickly at higher temperatures. Conversely, at a room air temperature below about 77° F. (25° C.), the urethane may be applied over longer periods of time. The coating is applied to a generally uniform thickness by brush. The thickness of the layer applied will be a function of the stiffness required and the composite coating being used. An application of approximately 1.0 gram of the EL301 urethane mixture per square inch of flexible fabric of module 40 is preferred. This coating achieves a module stiffness which substantially maintains the module in its illustrated form during usage of the suit. Rather than brush application, the composite coating may instead be spray applied.

After application of the urethane coating, the module 40, and more particularly its flexible fabric composite construction, is left to cure at room temperature for the next six to eight hours with the mold remaining inserted therein. Because the applied urethane coating penetrates the voids or interstices of the flexible fabric before it solidifies, the coating adheres tightly to the flexible fabric and will not chip off or otherwise be easily removed. Prior to its insertion into the flexible fabric pocket, the mold is coated with a waxy substance, such as Mold Release No. 1 also available from Ad-Tech of Charlotte, Mich. As a result of this release coating, the urethane coating does not stick or adhere to the mold, thus enabling the mold to be easily removed from module 40 after the initial 6 to 8 hour cure. Upon removal of the mold, module 40 has been sufficiently stiffened such that it will exhibit and maintain the same shape as the removed mold. However, at this point the urethane coating has not yet been completely cured. Therefore, a final cure is effected whereby module 40 is cured at room temperature for preferably five to seven more days to allow the flexible fabric composite to reach its maximum strength.

During the final curing, additional layers of urethane coating can be applied if desired. Due to the nature of the coating material, if too large an amount of the material is applied to the flexible fabric, it may run off the fabric and thereby not properly add to the coating thickness. Consequently, if additional thickness is desired, additional layers may be subsequently added. These additional coating or coatings are applied preferably within the first five days of the final curing process of the previously applied coating. Application at this time allows the latter coating to bind with the previous coating, which has not yet completely cured. To ensure that the latter coating will bind with the previous coating, it may be desirable to lightly sand the previous coating on the module prior to the application of the next coating. This sanding removes the outermost portion of the previous coating, thereby exposing the less cured inside region of the previous coating and allowing that region to come into contact and bind with the latter coating.

While the preferred type and mixtures of the above coatings and their means of application have been explained herein, those of ordinary skill in the art will recognize that alternate mixture combinations, coating materials, or means of application are within the teachings of the instant invention. Moreover, it will be appreciated that different types and amounts of coatings will create a product having different structural characteristics. These coatings may be desirable if it is determined that a modified shape requiring a different hold or a modified stiffness for a given weight of the various aerodynamic modules is preferred.

Figure 6:
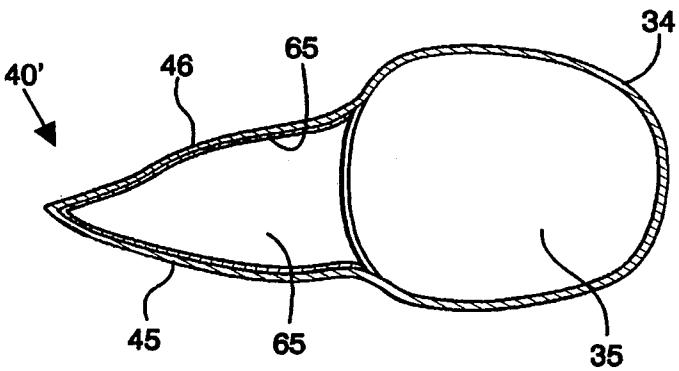
FIG. 6 is a cross sectional view, similar to the view of FIG. 4, of an alternately constructed aerodynamic wedge-shaped module of the suit, wherein the cyclist's arm has been removed from the suit.

An alternate method of fabricating an aerodynamic wedge-shaped module results in the incorporation of an additional layer of fabric within the constructed module. As shown in FIG. 6, fabric layer 65 lines the interior hollow 57 of module 40', which is externally configured identical to module 40 of FIGS. 1–5. Layer 65 preferably lines the entire hollow interior 57 and is actually the inserted fabric mold used to form the external shape of module 40' as presently explained. The fabrication of module 40' proceeds in a manner identical to the fabrication of module 40 until the point of fabrication at which the mold is inserted into the flexible fabric pocket. Rather than inserting the solid wood mold and applying a urethane coating to the exterior of the module, a hollow mold fabricated from woven fabric is inserted into hollow 57. The hollow fabric mold is preferably constructed from a woven cotton fiber which is hardened in the proper shape by application and cure of the same urethane coating described above. This hollow fabric mold can in practice be formed utilizing the wood mold used to form module 40. Before the urethane coating of the hollow fabric mold completely cures, an additional layer of urethane coating is first applied either directly to the interior of the flexible fabric pocket or the exterior of the hollow fabric mold, and then the hollow fabric mold is inserted into the fabric pocket, which stretches to accommodate the mold. In either case, the net effect is that the interior of the fabric pocket, which becomes the interior of top surface 50 and side surfaces 45, 46, has applied thereto a urethane coating. As this coating cures, the hollow mold, i.e. fabric layer 65, and flexible fabric surfaces are attached together. As a result of this construction, an additional thickness and a corresponding increase in rigidity or stiffness result.

Figure 7:
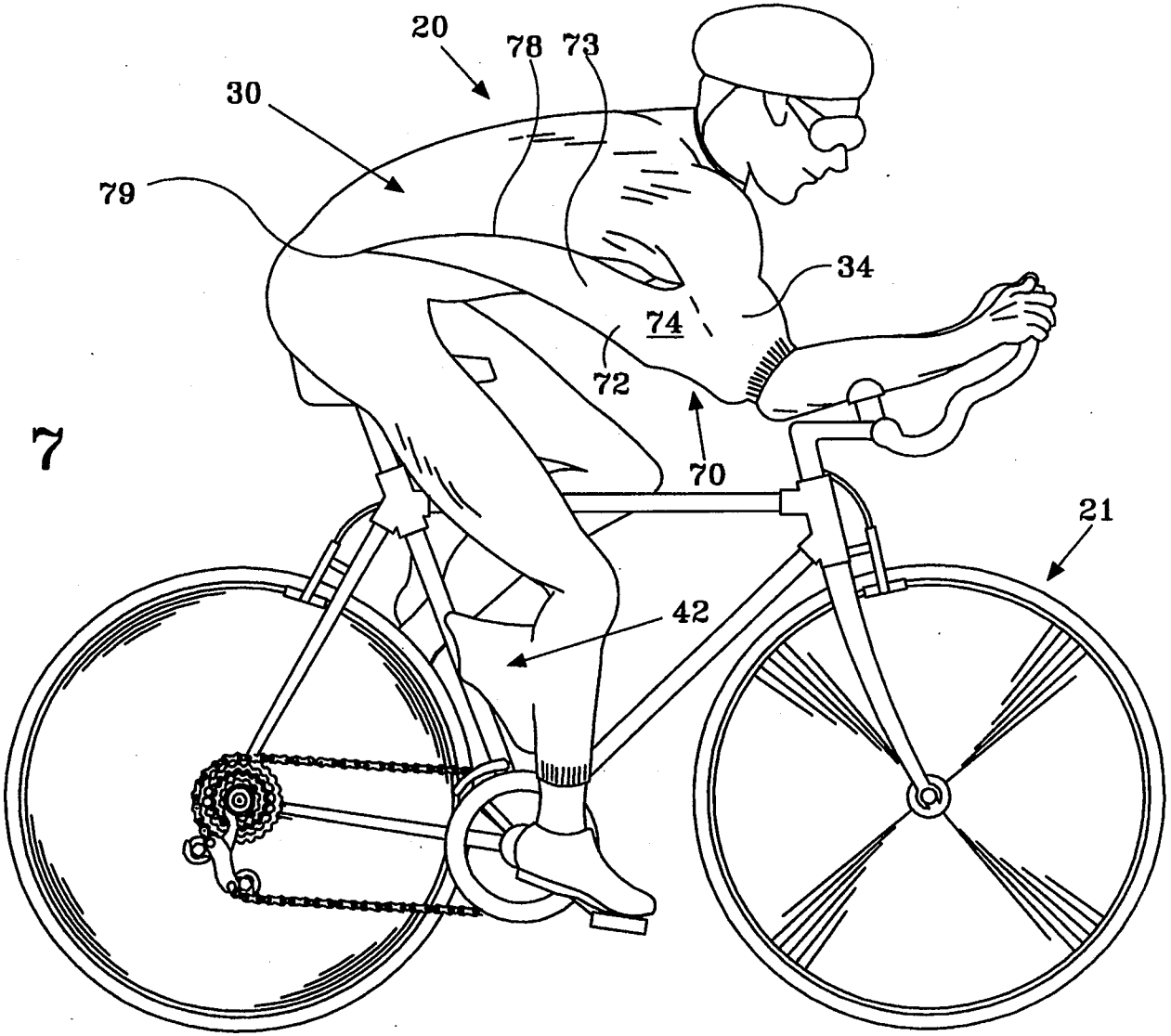
FIG. 7 is a side elevational view of a cyclist wearing a wind drag reducing suit with an alternate embodiment of the upper arm disposed aerodynamic wedge-shaped module of the present invention.

While the contour of the wedge-shaped aerodynamic modules disclosed in FIGS. 1–6 will improve the aerodynamics of cyclist 20 as well as other speed sport athletes such as skaters, alternate arm or leg mounted modules designs that improve aerodynamics, including designs which are not necessarily wedge shaped, are also considered to be within the scope of the invention. Moreover, the wedge shape can also be modified from the illustrated form. For instance, FIG. 7 illustrates a modified contour for a aerodynamic wedge-shaped module, generally designated 70, disposed on arm sleeve 34 of suit 30. The opposing sides 74, 75 (only side 74 is shown) each have an upper region 72 with an extended trail 73 that terminates proximate and blends into the hip region of cyclist 20. The far tip 79 of trail 73 reaches up to approximately 18" rearward of the back portion of arm sleeve 34. Despite extending further rearwardly than the corresponding portion of module 40, top surface 78 of module 70 is still slightly convex near the far tip 79 of trail 73. This particular embodiment, while somewhat more unwieldy than module 40 in that module 70 will likely whip around more than module 40, is believed more aerodynamically beneficial and may be favored in track riding where cyclist 20 remains in one position for the majority of the competition.

Figure 8:
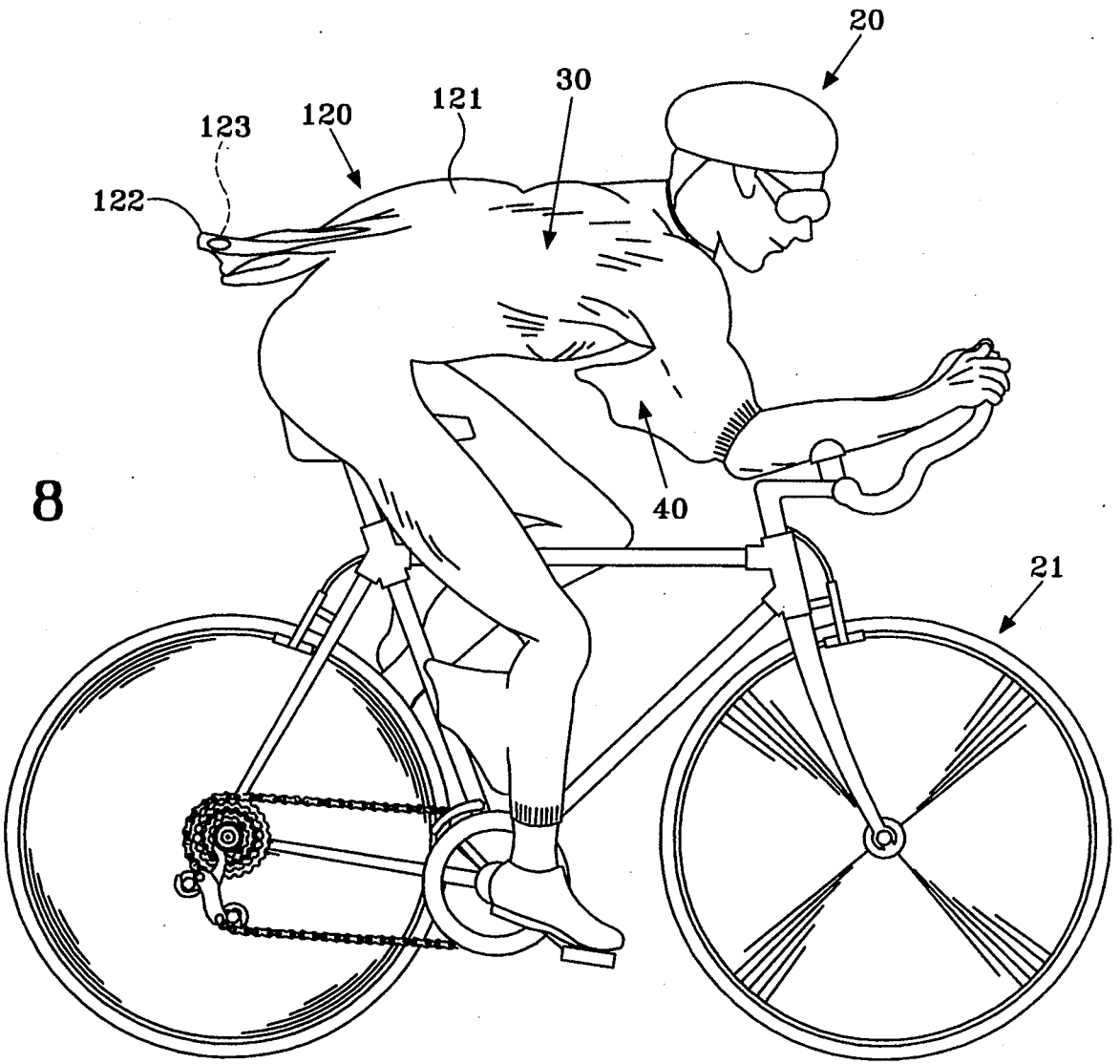
FIG. 8 is a side elevational view of the cyclist of FIG. 1 wearing a wind drag reducing suit with an additional type of aerodynamic module, namely a back mounted spoiler, of the present invention.

Additional aerodynamic modules of the present invention can be incorporated into suit 30, either without modules 40, 42 or preferably in conjunction with use of modules 40, 42. As shown in FIG. 8, the wind drag reducing suit 30 of cyclist 20 in FIG. 1 has been modified by the provision of a rear spoiler board, generally designated 120. As explained herein with respect to the construction of modules 40, 42, spoiler 120 is envisioned being formed integral with suit 30 by means of appropriately sized and shaped fabric extensions of suit 30 being first connected and then hardened with a urethane coating identified above. As described in the parent applications, the shape of spoiler board 120 includes a raised center rib 121 and oppositely disposed mirror image side wings 122, 123. The position and orientation of the rear spoiler board 120 on the cyclist is illustrated in FIG. 8. Employment of spoiler board 120 decreases wind drag as it prevents air flowing across the frontal surface of cyclist 20 from creating a vortex flow action which would create a suction-type of drag on cyclist 20.

Figure 9:
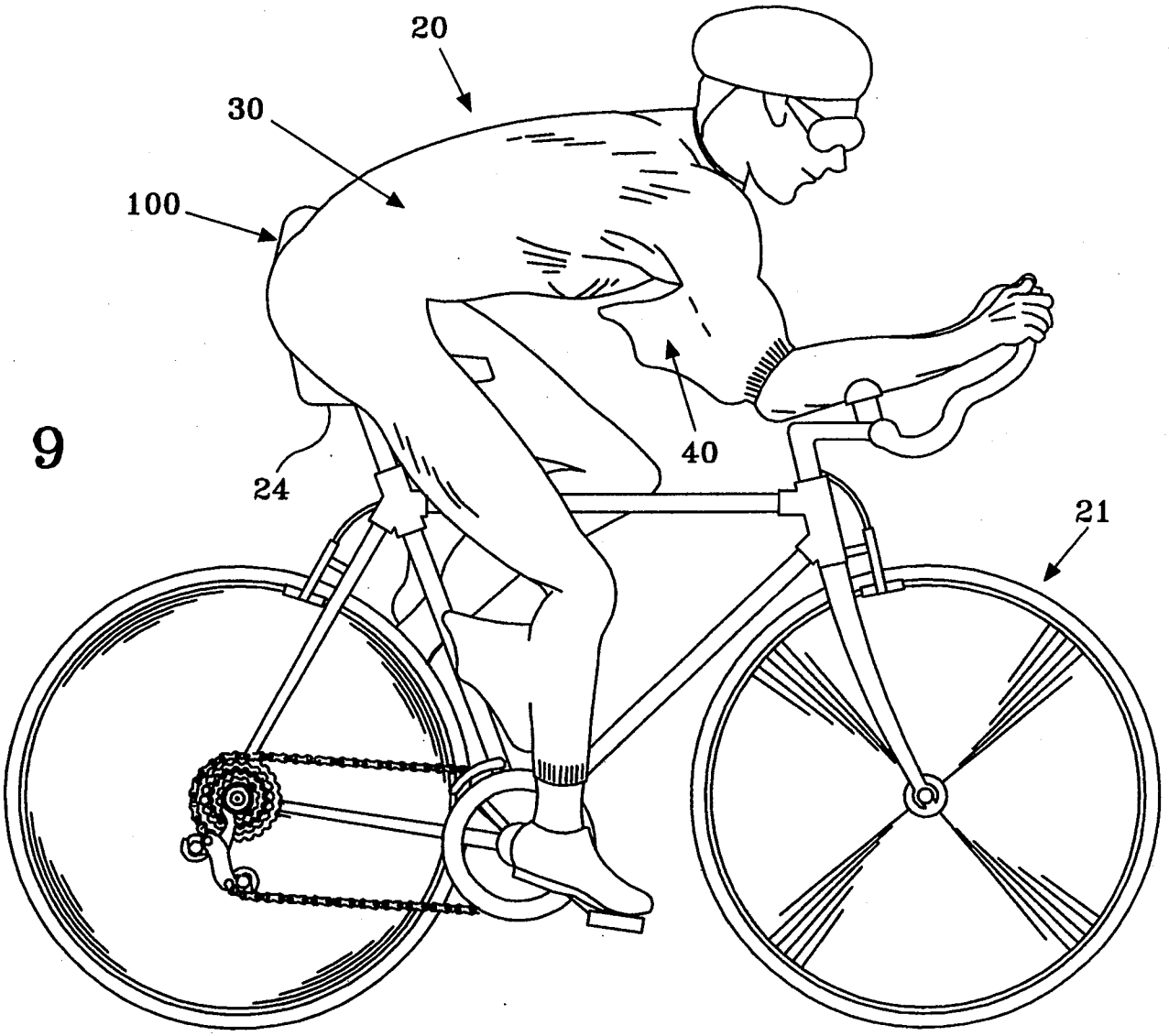
FIG. 9 is a side elevational view of the cyclist of FIG. 1 wearing a wind drag reducing suit with still another type of aerodynamic module, namely a pair of vortex generators, of the present invention.
Figure 11:
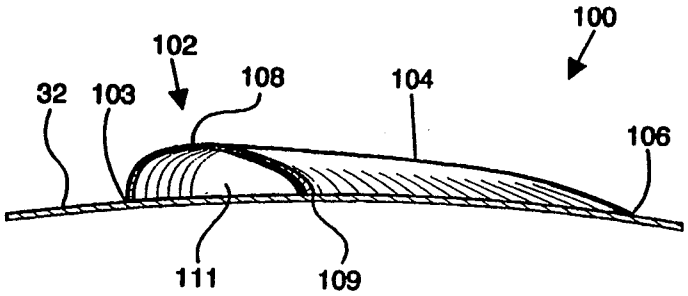
FIG. 11 is a cross sectional view of a vortex generator taken along line 11—11, or the center line of the vortex generator, of FIG. 10.
Figure 10:
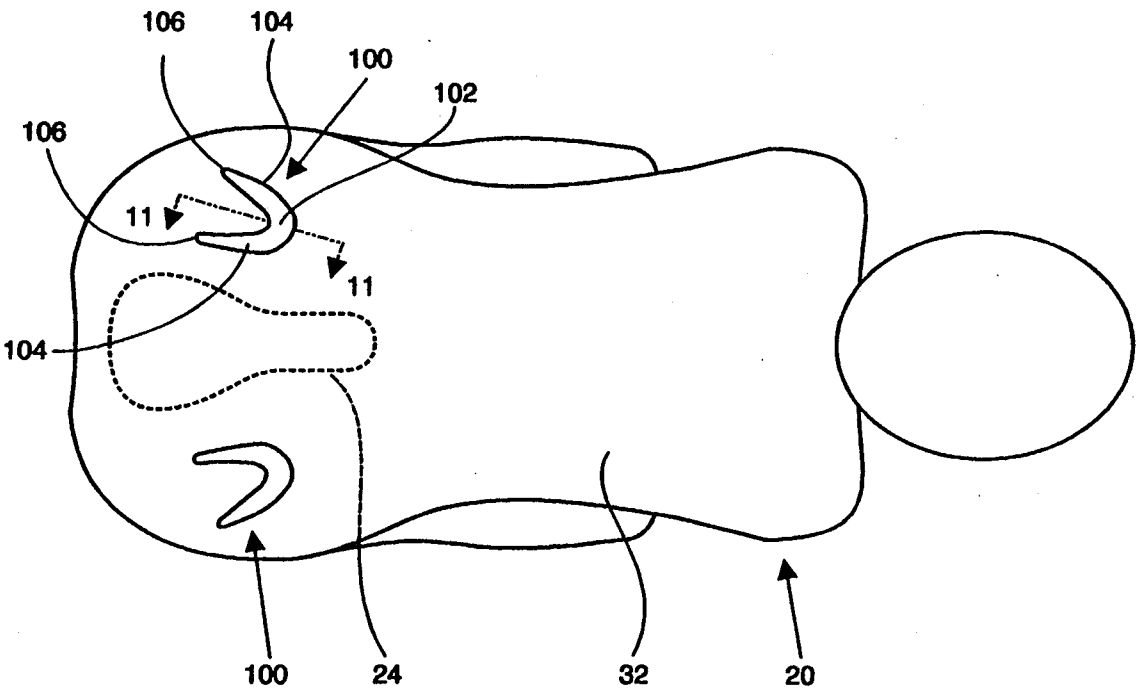
FIG. 10 is an abstract top view of the cyclist of FIG. 9 focusing on the cyclist's torso.

Referring to FIGS. 9–11, there is shown another embodiment of the wind drag reducing suit 30 with aerodynamic modules of the present invention. The aerodynamic modules employed in this version of suit 30 are a pair of vortex generators, generally designated 100. As shown in FIG. 9, vortex generators 100 are positioned on that lower rear portion of suit 30 which snugly covers the lower back region of the torso of cyclist 20. More particularly, vortex generators 100 are disposed over the kidney regions of cyclist 20. Although not illustrated, other portions of suit 30 can incorporate similarly shaped vortex generators to improve the aerodynamics of a speed sport athlete. For instance, as is frequently the case with wind drag reducing suits worn by skaters, the suit includes a flexible fabric hood, connected to the torso covering region of the suit, which tightly covers much of the skaters head. Similar suits can be worn by cyclists or skiers. A vortex generator 100 can be disposed on this hood near the top back portion of the athlete's head to prevent a vacuum from being formed at the nape of the athlete's neck. In addition, suit 30 could include additional vortex generators 100 on torso covering region 32 at, for example, the shoulder blade regions of cyclist 20.

Referring to FIGS. 10 and 11, each vortex generator 100 exhibits boomerang-like shape when viewed from above or when viewed in lateral cross section. In other words, vortex generator 100 is substantially a splayed-open-V-shaped element of suit 30. The V-point comprises a connecting region 102 having a leading edge 103. Generator 100 is oriented on suit 30 such that leading edge 103 is aimed directly into the air flowing over generator 100 which occurs when cyclist 20 is moving. The V-legs comprise a pair of symmetrical tapered extensions 104 which extend and diverge rearwardly from connecting region 102. Each tapered extension 104 terminates with rounded tip 106.

The dimensions of each generator 100 are variable in manufacture, and may be optimized by conducting wind tunnel tests to determine the most efficiently sized and shaped vortex generator 100 for a given wind drag reducing suit 30. The illustrated generator 100 possesses a width of 3.5 inches, as measured between tips 106 of diverging extensions 104, and a length of 3.5 inches, as measured perpendicularly from leading edge 103 to an imaginary line which connects tips 106. At high point 108 (see FIG. 11), vortex generator 100 protrudes approximately 0.25 inches above the surrounding exterior surface of suit 30.

As shown in FIG. 11, the vertical cross section of vortex generator 100 discloses a profile which is shaped similar to the upper half of an airplane wing or air foil. The bottom of generator 100 is flush with suit 30 and is generally flat. Because of the manner in which the illustrated embodiment is manufactured as described below, vortex generator 100 has a hollow interior 111. A solid generator can be substituted for the illustrated embodiment but is less desirable as it simply introduces unnecessary, although minimal, weight to suit 30. Parallel cross sections of generator 100 along the length of tapered extensions 104 disclose similar profiles. In the illustrated embodiment, high point 108 of connecting region 102 is positioned approximately 0.3 inches from leading edge 103 and 0.6 inches from trailing edge 109 of connecting region 102.

Several methods are presently envisioned for integrating vortex generators into suit 30. One method involves appliqueing a pair of 3-dimensional hollow vortex generators 100, as shown in FIG. 11, onto the exterior surface of suit 30. Each such vortex generator 100 is fabricated in the following manner. First, a solid male mold is provided. The male mold can be fabricated from a variety of materials including a rigid plastic material or wood. The male mold has a contoured bottom and is placed onto and flush with a contoured surface. The contoured mold bottom and contoured surface match the physique of a speed sport athlete where vortex generators 100 are to be located. For instance, if vortex generator 100 is to be incorporated into suit 30 at the suit location which snugly covers the shoulder blades, the mold bottom and placement surface would be shaped similar to the shoulder blade region of the athlete. The body of the mold above the bottom surface is preformed or cast in the desired shape of hollow interior 111, and therefore the above described generator shape and contour result. An appropriate mold release described above will have been previously applied to the generator mold. A sheet of flexible fabric, preferably the same LYCRA ® spandex material used in suit 30, is then placed over the mold. Because the mold is on a flat surface, and due to the thinness and suppleness of the fabric sheet, the placed fabric sheet will then appear to have a vortex generator underneath it. The fabric sheet overlying the male mold will then have a composite coating, such as the urethane compositions identified above, spray or brush applied. A rigid female mold, also precoated with a mold release, is then pressed down over the covered male mold, thereby sandwiching the coated fabric therebetween. The curing process as to the mold removal time and curing periods described with respect to the wedge-shaped modules 40 is then followed for the fabric sheet. After a complete curing, the hardened or solidified vortex generator shaped portion of the fabric sheet is then carefully cut from the sheet and, while retaining its hollow character, is appliqued to the exterior surface of the wind drag reducing suit 30 such that it projects from the surrounding surface. The method of applique can be by any conventional means such as adhesives or urethane coating or sewing.

Another method of creating vortex generators 100 integral with suit 30 and externally projecting therefrom involves placement of vortex generator shaped inserts on the interior of suit 30. For instance, first a rigid solid insert formed into the 3-dimensional shape of vortex generator 100, or alternatively a hollow flexible fabric composite insert formed in this shape, can be provided. In other words, these inserts are shaped identical to the male mold employed in the preceding generator creating process. The inserts are then attached, for instance by adhesives, to the interior surface of suit 30. This attachment is such that the rounded airfoil or top portion of each insert is proximate the suit interior surface and the flat portion of the insert faces the lower back of cyclist 20. When a suit 30 employing these internal vortex generator shaped inserts is worn by cyclist 20, the inserts abut cyclist 20 and the top portion of the inserts project from cyclist 20 and contact the overlying inner surface of suit 30. Consequently, the body hugging nature of suit 30 causes vortex generators 100 to appear on the exterior surface of suit 30.

Another possible and conceptually preferable method of creating vortex generators 100 in suit 30 involves forming a flexible fabric composite vortex generator within suit 30 itself. A solid male mold is first placed underneath suit 30 at the proper location, a urethane coating is applied to the exterior surface of suit 30 over the male mold, and a female mold then sandwiches the coated fabric against the male mold. After the above described curing process is completed, the hardened shell of the hollow vortex generator 100 protrudes from the exterior surface of suit 30.

Vortex generators 100 function to improve the aerodynamics of cyclist 20 in the following manner. Without vortex generators 100, air passing over the torso back of cyclist 20 follows the curve of the lower back region and flows off the torso, near the rearward extremity of the cyclist's back and buttocks, as an air sheet. As a result, a vacuum is formed rearward of cyclist 20 between this air sheet and the rearward extremity of the cyclist's back and buttocks. This vacuum undesirably detracts from the aerodynamics of cyclist 20. However, when vortex generators 100 are incorporated into suit 30, this vacuum is avoided. Specifically, air passing over the back torso portion of cyclist 20 encounters vortex generator 100, which creates air vortexes behind, or in other words rearwardly of, generator 100. Due to the positioning of generators 100 in the location illustrated in FIGS. 9 and 10, the spinning air produced eventually spins into the space behind the rearward extremity of the cyclist's back and buttocks, filling in the area where a vacuum would otherwise be formed had vortex generators not been utilized. As a result, the aerodynamics of cyclist 20 are enhanced.

While this invention has been described as having a number of preferred designs, the present invention may be further modified within the spirit and scope of this disclosure. For instance, the general shape and contour of the suit arm sleeve mounted module may be modified should future experiments or wind tunnel tests lead to the development of an even more aerodynamic configuration. In addition, although only a cyclist was actually illustrated herein as utilizing the suit with aerodynamic modules of the present invention, the suit is also believed beneficial and desirable to speed sport athletes such as skiers and skaters. This application is therefore intended to cover any variations, uses, or adaptations of the invention using its general principles. Further, this application is intended to cover such departures from the present disclosure as come within known or customary practice in the art to which this invention pertains.

What is claimed is:

1. A wind drag reducing suit for a speed sport athlete comprising;

a torso covering means for covering at least a part of the torso of the athlete;

a sleeve means defining a passageway for receiving a limb of the athlete therein when the suit is worn by the athlete, said sleeve means extending from said torso covering means, wherein said sleeve means comprises a flexible fabric; and an aerodynamic wind drag reducing module integral with said sleeve means, said module being substantially wedge-shaped in cross section transverse to said sleeve means passageway, and wherein said aerodynamic wind drag reducing module comprises a flexible fabric composite.

2. The wind drag reducing suit of claim 1 wherein said aerodynamic wind drag reducing module extends rearwardly from said sleeve means and comprises a top surface, a trailing edge, and opposing side surfaces.

3. The wind drag reducing suit of claim 1 wherein the limb comprises a right upper arm, and further comprising a second sleeve means defining a passageway for receiving a left upper arm therein when the suit is worn by the athlete, said second sleeve means extending from said torso covering means, and a second aerodynamic wind drag reducing module integral with said second sleeve means, said second module being substantially wedge-shaped in cross section transverse to said second sleeve means passageway.

4. The wind drag reducing suit of claim 3 further comprising at least one vortex generator projecting from an exterior surface of said torso covering means, said at least one vortex generator having a substantially splayed-open-V-shape.

5. The wind drag reducing suit of claim 4 further comprising a rear spoiler board integral with said torso covering means.

6. The wind drag reducing suit of claim 3 further comprising:

a third sleeve means defining a passageway for receiving a right leg calf therein when the suit is worn by the athlete, said third sleeve means extending from said torso covering means, and a third aerodynamic wind drag reducing module integral with said third sleeve means and located at the right leg calf, said third module being substantially wedge-shaped in cross section transverse to said third sleeve means passageway; and a fourth sleeve means defining a passageway for receiving a left leg calf therein when the suit is worn by the athlete, said fourth sleeve means extending from said torso covering means, and a fourth aerodynamic wind drag reducing module integral with said fourth sleeve means and located at the left leg calf, said fourth module being substantially wedge-shaped in cross section transverse to said fourth sleeve means passageway.

7. The wind drag reducing suit of claim 6 further comprising at least one vortex generator projecting from an exterior surface of said torso covering means, said at least one vortex generator having a substantially splayed-open-V-shape.

8. The wind drag reducing suit of claim 1 wherein the limb comprises a right leg calf, and further comprising a second sleeve means defining a passageway for receiving a left leg calf therein when the suit is worn by the speed sport athlete, said second sleeve means extending from said torso covering means, and a second aerodynamic wind drag reducing module integral with said second sleeve means and located at the left leg calf, said second module being substantially wedge-shaped in cross section transverse to said second sleeve means passageway.

9. A wind drag reducing suit for a speed sport athlete comprising:

a sleeve means defining a passageway for receiving a limb of the athlete therein, said sleeve means comprising a flexible fabric;

an aerodynamic module for reducing wind drag on the speed sport athlete connected to said sleeve means, said module comprising a flexible fabric composite.

10. The wind drag reducing suit of claim 9 wherein said flexible fabric composite of said aerodynamic module comprises:

a first flexible fabric side surface extending rearwardly from said sleeve means, a second flexible fabric side surface extending rearwardly from said sleeve means, wherein said first and second flexible side surfaces converge rearwardly, and coating means for stiffening said first and second flexible fabric side surfaces in a preselected aerodynamic form.

11. The wind drag reducing suit of claim 10 wherein said coating means is applied to the exterior of said first and second flexible fabric side surfaces.

12. The wind drag reducing suit of claim 10 wherein said first and second flexible fabric side surfaces define a hollow interior, wherein the wind drag reducing suit further comprises a hollow fabric mold positioned within said hollow interior, and wherein said coating means is applied to the interior of said first and second flexible fabric side surfaces.

13. The wind drag reducing suit of claim 10 wherein said aerodynamic module is of unitary construction with said sleeve means.

14. The wind drag reducing suit of claim 9 wherein said aerodynamic module comprises a hollow interior, said hollow interior opening into said sleeve means passageway.

15. The wind drag reducing suit of claim 9 wherein said aerodynamic module is substantially wedge-shaped in cross section transverse to said sleeve means passageway.

16. A wind drag reducing suit for a speed sport athlete comprising:

a torso covering means for covering at least a part of the torso of the athlete; and a rear spoiler board integral with said torso covering means, said spoiler board comprising a flexible fabric composite, said spoiler board being disposed on the back of the speed sport athlete when the suit is worn.

17. A wind drag reducing suit for a speed sport athlete comprising;

a torso covering means for covering at least a part of the torso of the athlete;

a sleeve means defining a passageway for receiving a limb of the athlete therein when the suit is worn by the athlete, said sleeve means extending from said torso covering means, wherein said sleeve means, during use by the speed sport athlete traveling in a first direction, includes a forward periphery forming a frontal surface area exposed to oncoming air; and an aerodynamic module configured and arranged on said suit for reducing wind drag integral with said sleeve means, said module being substantially wedge-shaped in cross section transverse to said sleeve means passageway and tapering rearwardly therefrom, wherein relative to the first direction said aerodynamic module is located entirely behind said frontal surface area to avoid providing further frontal surface area exposed to the oncoming air, whereby wind drag on the speed sport athlete is reduced.

18. The wind drag reducing suit of claim 17 wherein said aerodynamic module comprises a top surface, a trailing edge, and opposing side surfaces.

19. The wind drag reducing suit of claim 17 wherein said sleeve means comprises a flexible fabric, and wherein said aerodynamic module comprises a flexible fabric composite.

20. The wind drag reducing suit of claim 17 wherein the limb comprises a right upper arm, and further comprising a second sleeve means defining a passageway for receiving a left upper arm therein when the suit is worn by the athlete, said second sleeve means extending from said torso covering means, wherein said second sleeve means, during use by the speed sport athlete traveling in the first direction, includes a second forward periphery forming a second frontal surface area exposed to oncoming air, and a second aerodynamic module for reducing wind drag integral with said second sleeve means, said second module being substantially wedge-shaped in cross section transverse to said second sleeve means passageway and tapering rearwardly therefrom, wherein relative to the first direction said second aerodynamic module is located behind said second frontal surface area to avoid providing further frontal surface area exposed to the oncoming air, whereby wind drag on the speed sport athlete is reduced.

21. The wind drag reducing suit of claim 20 further comprising at least one vortex generator projecting from an exterior surface of said torso covering means, said at least one vortex generator having a substantially splayed-open-V-shape.

22. In a wind drag reducing suit for a speed sport athlete, the suit comprising an exterior surface, the improvement comprising:

at least one vortex generator projecting from said exterior surface of the suit, said vortex generator being structured and arranged on said suit such that the aerodynamics of an athlete utilizing said suit are improved;

wherein said vortex generator includes a substantially splayed-open-V-shape and comprises a connecting region and a pair of tapered extensions, wherein said tapered extensions extend toward the rear of the speed sport athlete; and wherein said vortex generator comprises an insert attached to an interior surface of said torso covering means.

* * * * *